US005795017A

United States Patent [19]

Zimmerman et al.

[11] Patent Number: 5,795,017

[45] Date of Patent: Aug. 18, 1998

[54] STOWABLE FISH FIGHTING CHAIR

[76] Inventors: Matthew K. Zimmerman; Lee H. Zimmerman, both of 1265 Danbury NW., North Canton, Ohio 44720

[21] Appl. No.: 746,863

[22] Filed: Nov. 18, 1996

[51] Int. Cl.[6] ..... A47C 9/06

[52] U.S. Cl. ..... 297/15; 297/378.1; 297/344.18; 297/423.28; 297/188.05

[58] Field of Search ..... 297/344.18, 344.19, 297/14, 15, 378.1, 423.35, 423.26, 188.04, 188.05; 114/363, 188, 194

[56] References Cited

U.S. PATENT DOCUMENTS

| | | | |
|---|---|---|---|
| 619,153 | 2/1899 | Egan et al. . | |
| 816,899 | 4/1906 | Chase et al. | 297/15 |
| 841,135 | 3/1907 | Finch . | |
| 842,660 | 1/1907 | Harvey . | |
| 958,000 | 5/1910 | Peterson et al. . | |
| 1,062,010 | 5/1913 | Jacobson | 297/15 X |
| 1,887,947 | 11/1932 | Savale | 297/15 |
| 4,234,989 | 11/1980 | Pearcy | 114/363 |
| 4,566,734 | 1/1986 | Bruner | 297/15 X |
| 4,652,046 | 3/1987 | Chatenay | 297/15 |
| 5,195,795 | 3/1993 | Cannera et al. | 297/15 X |
| 5,197,406 | 3/1993 | Rabal et al. | 114/363 |
| 5,228,744 | 7/1993 | Sugiyama | 297/15 |
| 5,271,190 | 12/1993 | Sugiyama | 52/10 |
| 5,324,093 | 6/1994 | Sugiyama | 279/15 |

FOREIGN PATENT DOCUMENTS

| | | | |
|---|---|---|---|
| 804978 | 11/1936 | France | 297/423.28 |

OTHER PUBLICATIONS

Catalog Price List, Murray Brothers Products, 15 pages, Oct. 1995.

*Primary Examiner*—Milton Nelson, Jr.
*Attorney, Agent, or Firm*—Renner, Kenner, Greive, Bobak, Taylor & Weber

[57] ABSTRACT

A fish fighting chair assembly (10) is capable of being stored in a chamber (20) below the deck surface (18) of a boat. A foldable chair (12) is supported by a lifter (14) that is operable to raise the chair (12) from the storage chamber (20) to an above deck position. A pair of doors (30) are pivotally attached to the deck (18) and engage the lifter (14) when the doors (30) are closed to provide support to the lifter (14). The foldable chair assembly (12) includes a seat member (52) that pivotally carries a foot rest (60) that is foldable up underneath the seat member (12) and a seat back (56) that is also pivotally carried by the seat member (52) and is foldable down on top of the seat member (52). When the chair members are in their folded position, a compact body (50) is formed that may be lowered beneath the deck (18) into the storage chamber (20).

13 Claims, 4 Drawing Sheets

STOWABLE FISH FIGHTING CHAIR

TECHNICAL FIELD

The present invention relates to a stowable fighting chair for a fishing boat. More particularly, the present invention relates to a fighting chair for a fishing boat that may be completely folded up and lowered to a below-deck storage chamber.

BACKGROUND ART

Fighting chairs for fishing boats are typically permanently installed, as by bolts, on the rear deck of a fishing boat and are utilized by the fisherman during the time that he is fighting to land a fish, which time is often longer than an hour. One problem is that for every hour or two that the chair might be being utilized, there are tens of hours when it is not being used. As such, the chair impedes free movement around the deck, or is otherwise in the way of deck activities such as fishing, docking, maintenance, and the like, for the many hours that it is not in use.

Moreover, such chairs are quite expensive and are permanently exposed to the sun, wind, and/or corrosive sea water. As such, the useful life of the chairs is severely diminished.

The need thus exists for a fish fighting chair which can be stowed away when not in use so that it is not constantly exposed to the elements and so that it does not impede facile movement around the boat. Yet such a stowable chair must be as strong as the permanently mounted chairs so as to withstand the considerable force of an adult fighting to land a large fish onto the boat.

DISCLOSURE OF THE INVENTION

It is therefore an object of the present invention to provide a fish fighting chair that is quickly and easily removable from and positionable on the deck of a boat.

It is another object of the present invention to provide a fish fighting chair, as above, that may be folded up and lowered to a stored position in a compartment formed below the deck surface of a boat.

It is a further object of the present invention to provide a fish fighting chair, as above, wherein door members that close the compartment when a chair is in use provide support for the chair.

It is yet another object of the present invention to provide a fish fighting chair, as above, which utilizes a hydraulic lift that is incorporated into the pedestal of the chair to cause the chair to be raised above the deck and to be lowered below the deck.

These and other objects of the invention, as well as the advantages thereof over existing and prior art forms, which would be apparent in view of the following detailed specification, are accomplished by the improvements hereinafter described and claimed.

In general, a chair storable below a deck surface on a boat includes a chair, a lifter to move the chair from a first position below the deck surface of the boat to a second position above the deck surface on the boat, and a door assembly pivotally connected to the deck surface to allow the chair to move below the deck when the door assembly is opened and to provide support to the lifter when the door assembly is closed and the chair is in the second position.

To acquaint persons skilled in the arts most closely related to the present invention, one the preferred embodiment of a fish fighting chair that illustrates a best mode now contemplated for putting the invention into practice is described herein by, and with reference to the annexed drawings that form a part of the specification. The exemplary fish fighting chair is described in detail without attempting to show all of the various forms and modification in which the invention might be embodied. As such, the embodiment shown and described herein is illustrative, and as will become apparent to those skilled in these arts, can be modified in numerous ways within the spirit and scope and the invention; the invention being measured by the appended claims and not by the details of the specification.

PREFERRED EMBODIMENT FOR CARRYING OUT THE INVENTION

Figure 1:
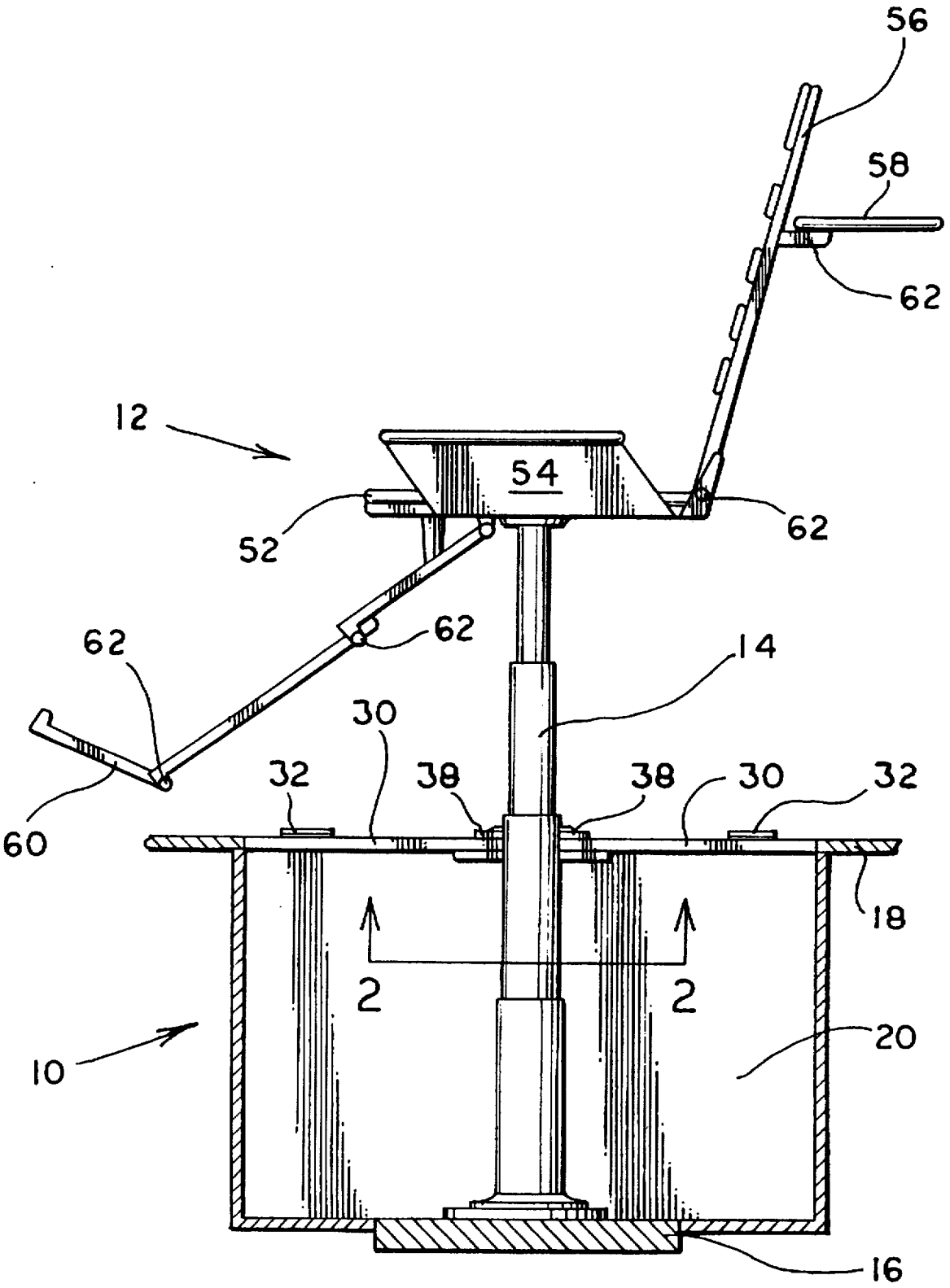
FIG. 1 is a somewhat schematic side elevational view of a fish fighting chair assembly in an unfolded, above-deck position.

A fish fighting chair assembly made in accordance with the concepts of the present invention is generally indicated by the numeral 10 and includes a foldable chair assembly generally indicated by the numeral 12 which is supported, in part, by a lifter 14. In the preferred embodiment of the present invention, lifter 14 is shown as a telescoping hydraulic cylinder that is incorporated into or otherwise forms the pedestal of the chair 10. Hydraulic lift cylinder 14 is carried by a structural member 16 of the boat and is operable to raise the foldable chair assembly 12 above the deck 18 of the boat and to lower foldable chair assembly 12 below deck 18 into a storage chamber 20 formed below deck 18.

Figure 2:
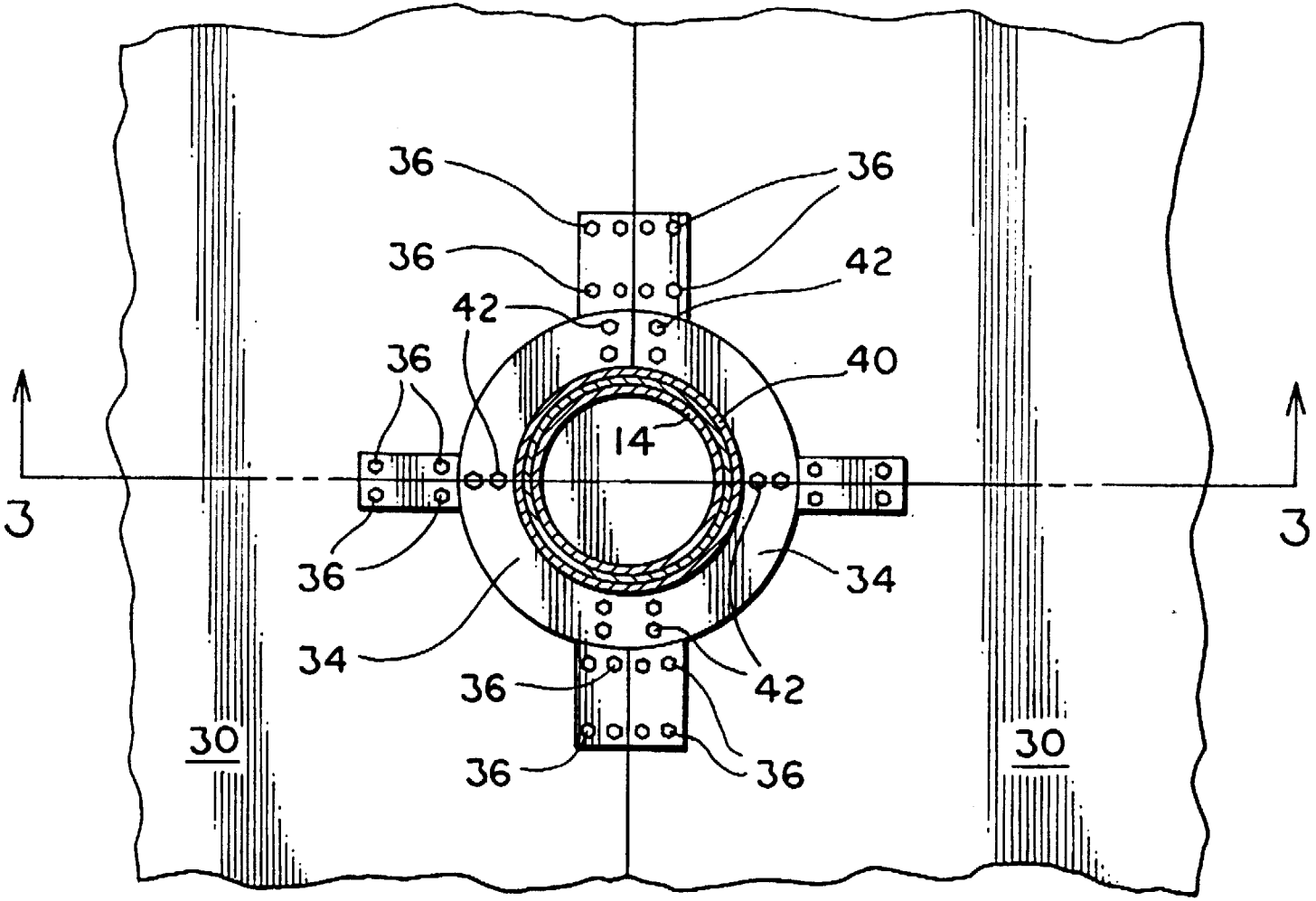
FIG. 2 is an enlarged, fragmented bottom view of the fish fighting assembly and its laterally supporting brace members as viewed substantially along the line 2—2 of FIG. 1.
Figure 3:
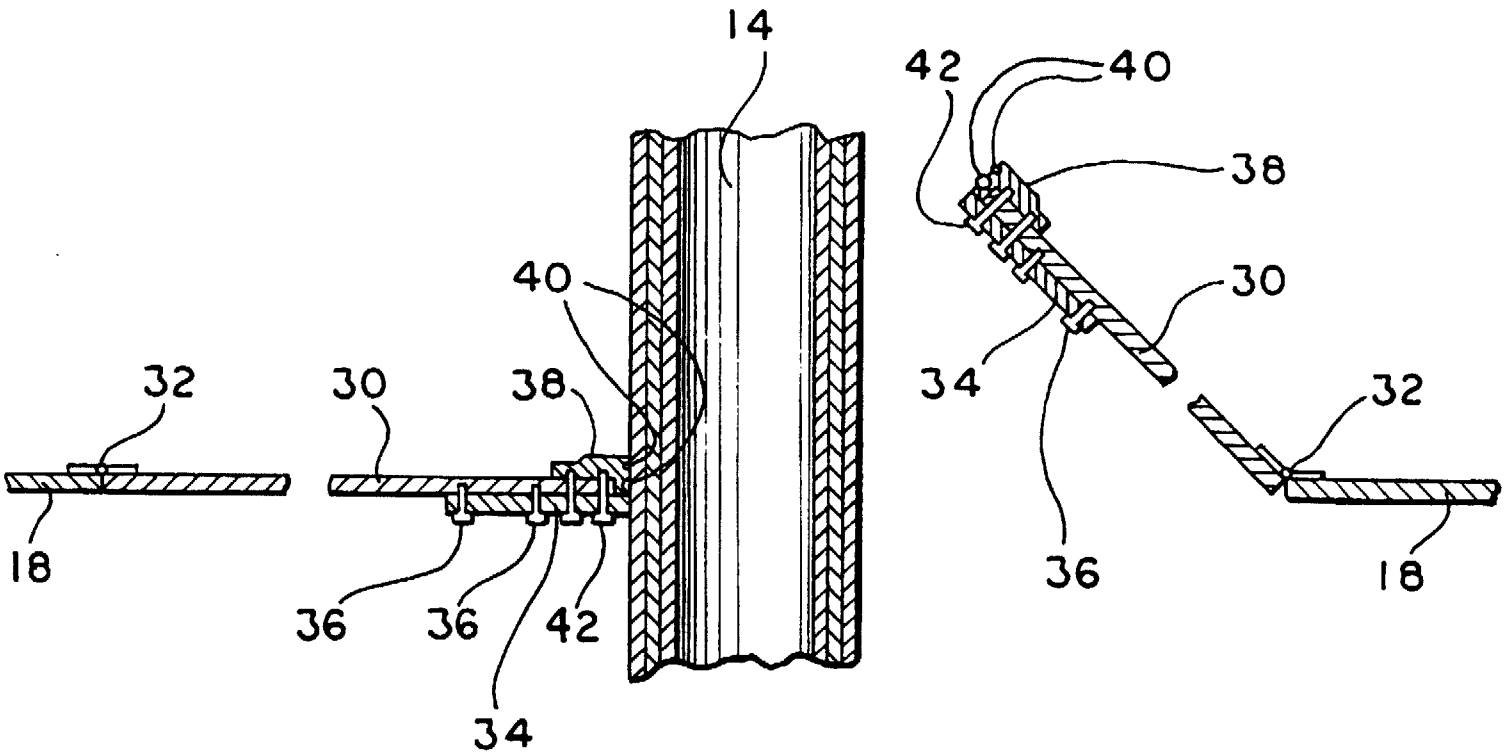
FIG. 3 is a fragmented sectional view taken substantially along line 3—3 of FIG. 2 and showing the two door members that engage the hydraulic lifter which supports the chair, one of the doors being shown in a partially raised position.

When chair assembly 12 is in the unfolded, above-deck position as shown in FIG. 1, a door assembly which includes a pair of doors 30 engages hydraulic lift cylinder 14 and provide lateral support to hydraulic lift cylinder 14 in addition to the lateral and vertical support provided by structural member 16. As best seen in FIGS. 2 and 3, each door 30 is attached to deck 18 by a hinge 32. Bracing is provided by a support plate 34 having an inner arcuate edge is attached to the inner end of each door 30 by suitable connectors 36, such as bolts. A metal flange 38 having an inner semicircular edge is also connected to the inner end of each door 30 that engages hydraulic lift cylinder 14. When doors 30 are in a closed position, they thus encircle lift cylinder 14. At its inner end, flange 38 carries at least one, and preferably two, members 40, preferably in the form of elastomeric o-ring portions that engage cylinder 14 as doors 30 close around cylinder 14. Each flange 38 is attached to each door 30 and support plate 34 by suitable connectors 42, such as bolts. Because the configuration of flange 38 substantially matches the configuration of cylinder 14 a tight and sealed fit is provided between doors 30 and cylinder 14. This tight fit allows doors 30 to function as support members to cylinder 14 when cylinder 14 is fully extended and chair assembly 12 is in the above-deck position. Also, o-ring members 40 serve to provide a seal between doors 30 and cylinder 14 so that water which is inevitably present on deck 18 cannot enter chamber 20.

Figure 4:
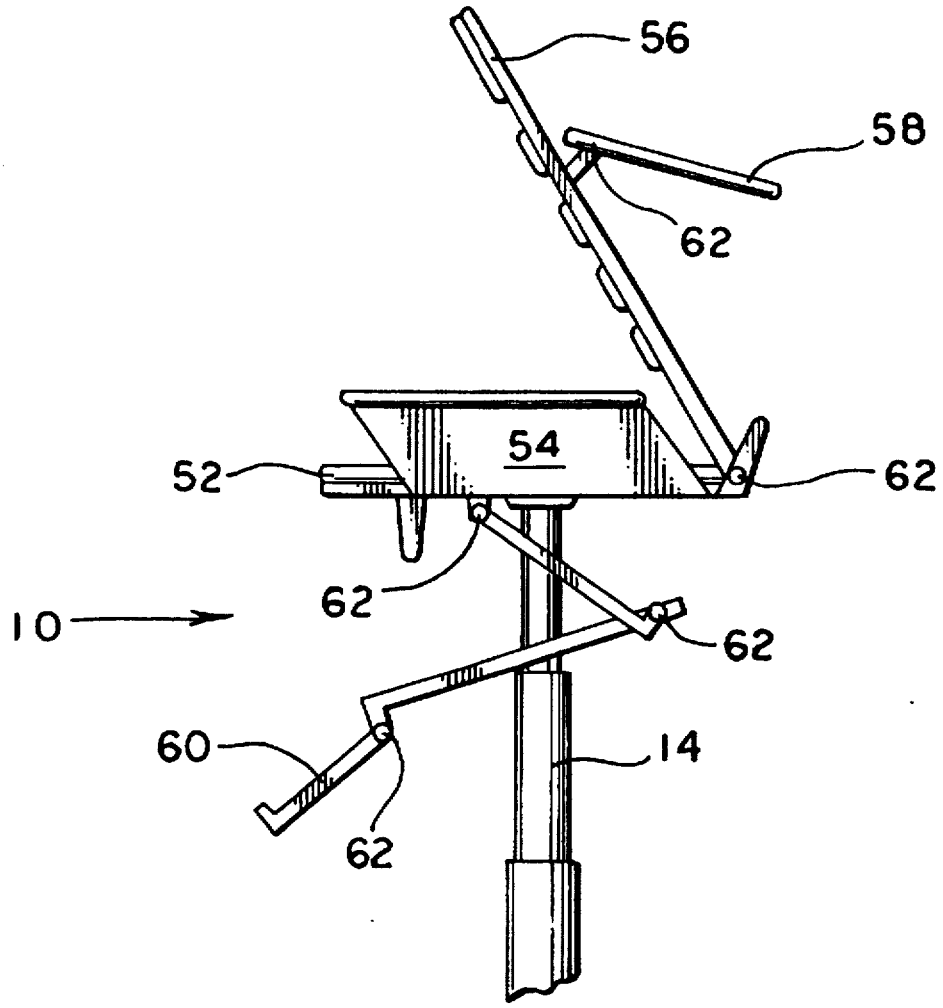
FIG. 4 is a side elevational view depicting the steps required to fold the chair from an unfolded position to a folded position.
Figure 5:
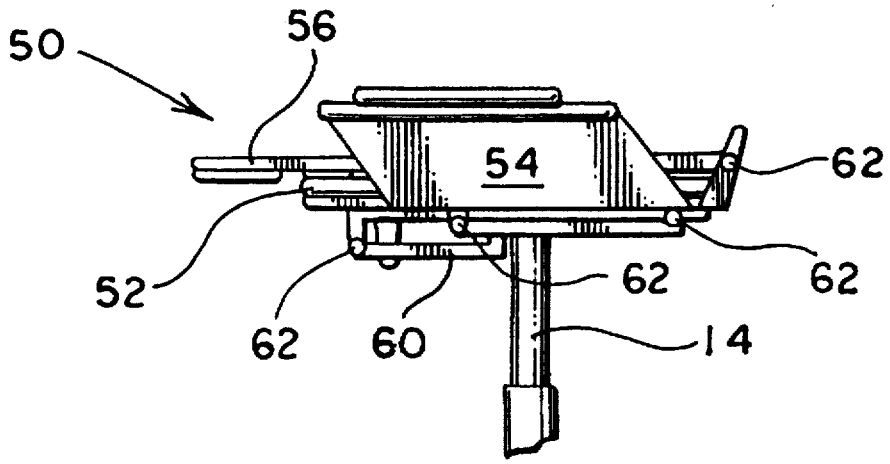
FIG. 5 is a side elevational view of the fish fighting chair assembly in the folded condition.

As may be best seen in FIGS. 4 and 5, chair assembly 12 includes a plurality of chair members that are foldable into a compact body 50. The chair members of the embodiment of chair assembly 12 depicted in the drawings include a seat member 52 that supports a pair of arm rests 54 and a seat back 56. Seat back 56 further provides support for a bait preparation table and rod holder 58 that may be selectively rotated between a stored position and an open position. Also supported by seat member 52 is a foot rest 60. When the chair members are extended to form the above-deck, unfolded position, suitable means are provided at each of the pivotable joints 62 to prevent the chair members from collapsing.

The steps of folding chair assembly 12 from the unfolded position to the folded position are depicted in FIG. 4. First, foot rest 60 is folded back on itself on its three pivot joints 62. Next, chair back 56 is pivoted down onto seat member 52. Table 58 may then be collapsed against seat back 56. Lastly, the collapsed foot rest 60 is folded up underneath seat member 52. Once the chair members are folded into compact body 50, doors 30 may be opened and hydraulic cylinder 14 may be activated to lower compact body 50 below deck surface 18. After compact body 50 is fully disposed under deck surface 18, doors 30 are closed and chair assembly 12 is stored. The opening left by the absence of the hydraulic cylinder 14 may then be closed by a cap (not shown) which can be machined or formed so that it occupies and otherwise seals the opening. Of course, when chair 12 is needed, the cap is removed doors 30 are opened, telescoping cylinder 14 is activated to raise compact body 50 which can then be unfolded, and doors 30 are closed to support cylinder 14.

We claim:

1. A chair assembly for a boat, the chair assembly being storable below a deck surface on the boat and comprising a chair, a lifter to move said chair between a first position below the deck surface of the boat and a second position above the deck surface of the boat, and a door assembly capable of being pivotally connected to the deck surface and thereby being movable from open and closed positions, said chair being allowed to be moved above and below the deck surface when said door assembly is in said open position, said door assembly providing support to said lifter when said chair is in said second position, said door assembly including means to seal the deck surface at the area of said lifter.

2. A chair assembly according to claim 1 wherein said chair includes a plurality of chair members that are foldable into a compact body.

3. A chair assembly according to claim 2 wherein said chair members include a seat member, a seat back selectively pivotally attached to said seat member, and a foot rest selectively pivotally attached to said seat member.

4. A chair assembly according to claim 3 wherein said foot rest folds under said seat member and said seat back folds down on top of said seat member to form said compact body.

5. A chair assembly according to claim 1 wherein said door assembly includes a pair of doors, each of said doors capable of being pivotally carried by the deck surface of the boat such that each door may be selectively pivoted to said open position.

6. A chair assembly for a boat, the chair assembly being storable below a deck surface on the boat and comprising a chair, a lifter to move said chair between a first position below the deck surface of the boat and a second position above the deck surface of the boat, and a door assembly including a pair of doors, each of said doors being capable of being pivotally carried by the deck surface of the boat such that each door may be selectively pivoted to an open position which allows said chair to be moved above and below the deck surface and to a closed position wherein each of said doors engages said lifter to provide support to said lifter when said chair is in said second position.

7. A chair assembly according to claim 6 wherein each of said doors carries a member that forms a seal between each said door and said lifter when said doors are closed.

8. A chair assembly according to claim 6 wherein each of said doors carries a flange, each of said flanges having an inner edge that engages said lifter when said doors are closed to provide support to said lifter.

9. A chair assembly according to claim 8 further comprising a member carried by each said flange such that said members form a seal between said lifter and each said door when said doors are closed.

10. A chair assembly according to claim 9 wherein said members are o-ring portions.

11. A chair assembly according to claim 6 wherein said door assembly includes a support plate attached to each of said doors to provide strength to said doors.

12. A chair assembly according to claim 11 further comprising flanges having inner edges that engage said lifter, one of said flanges carried by each of said doors.

13. A chair assembly according to claim 12, further comprising at least one o-ring portion carried by each of said flanges, each o-ring portion forming a seal between said lifter and each said door when said doors are closed.

* * * * *